United States Patent [19]

Mekosh, Jr.

[11] Patent Number: 4,688,777

[45] Date of Patent: Aug. 25, 1987

[54] PAIR OF STACKED SPRINGS FOR A RAILWAY CAR

[75] Inventor: George Mekosh, Jr., Warrington, Pa.

[73] Assignee: The Budd Company, Troy, Mich.

[21] Appl. No.: 793,930

[22] Filed: Nov. 1, 1985

[51] Int. Cl.[4] ..... F16F 1/36

[52] U.S. Cl. ..... 267/141.1; 267/259; 267/153; 105/197.05

[58] Field of Search ..... 267/63 R, 33, 35, 141, 267/141.1, 141.3, 152, 140.3, 140.5, 153; 105/197 A

[56] References Cited

U.S. PATENT DOCUMENTS

| | | | |
|---|---|---|---|
| 2,406,601 | 8/1946 | Flyer | 267/140.3 |
| 3,480,268 | 11/1969 | Fishbaugh | 267/141.1 |
| 3,606,295 | 9/1971 | Appleton | 267/141.1 |
| 3,762,694 | 10/1973 | MacDonnell | 105/197 A |
| 3,904,181 | 9/1975 | Hársy-Vadas | 267/35 |
| 4,531,781 | 7/1985 | Hunt et al. | 280/716 |

*Primary Examiner*—George E. A. Halvosa
*Assistant Examiner*—Matthew C. Graham
*Attorney, Agent, or Firm*—Edward M. Farrell; Herman Foster; Thomas I. Davenport

[57] ABSTRACT

A pair of stacked springs are connected between a main railway car body and a truck. At least one of the springs include an elastomeric member having a center opening therein. Restricting members are provided to limit the lateral movement of one of the springs while permitting free vertical movements of both of the springs.

4 Claims, 3 Drawing Figures

PAIR OF STACKED SPRINGS FOR A RAILWAY CAR

BACKGROUND OF THE INVENTION

In many cases mechanical springs are used in railway car suspension systems, sometimes accompanied by bellows air spring. Mechanical springs generally cause vibrations, surges, and noise which are generally transmitted from the truck to the car body. This causes passenger discomfort. The vibrations, surges, and noise result from a number of operating conditions. For example, the mechanical springs may have natural frequencies at which they tend to vibrate. Sudden impacts transmitted from the tracks through the wheels of the truck may cause surges and noise in the springs which in turn are transmitted to the car body.

Different types of damping elements have been used in connection with mechanical springs. Generally, these have been located at the top and bottom of the springs. Such arrangements have not been entirely successful in sufficiently damping the vibrations and preventing them from being transmr,tted to the railway car body.

Recently there have been developed by Firestone, a so-called "Marsh Mellow" ® spring, which eliminate many problems relating to vibrations. One example of these springs include an elastomeric core with a hollow center with several plies of cord-reinforced fabric serving as the outer cover.

In railway car applications, it was found that it is necessary to provide springs for a suspension system which control the relative spring rates between the vertical and lateral movements. Very often, it is desirable to provide a predetermined vertical spring rate with restrictive lateral spring rates. Vertical spring rates in a single spring are limited because making a single spring too high creates a tendency of the spring to tilt over.

The main patents found during a search of the subject matter of this invention included U.S. Pat. Nos. 4,080,061; 3,910,655; 3,799,066; and 4,174,140. None of these patents disclosed a pair of stacked springs with one of the springs being elastomeric and one being restrictive in lateral movement.

OBJECTS OF THE INVENTION

It is an object of this invention to provide an improved suspension spring system between a railway car body and truck, in which a predetermined vertical spring rate is provided with a restricted lateral spring rate.

It is a further object of this invention to provide an improved suspension spring system for a railway car in which mechanical vibrations are minimized.

SUMMARY OF THE INVENTION

In accordance with the present invention, a pair of stacked springs are connected between a railway car body and a truck. One of the springs includes an elastomeric member with a center opening therein. Means are provided to restrict the lateral movement of one of the springs, with both of the stacked springs being free to move vertically.

Other objects and advantages of the present invention will be apparent and suggest themselves to those skilled in the art from a reading of the following specification and claims, taken in conjunction with the accompanying drawings.

DETAILED DESCRIPTION OF THE PREFERRED EMBODIMENTS

Figure 1:
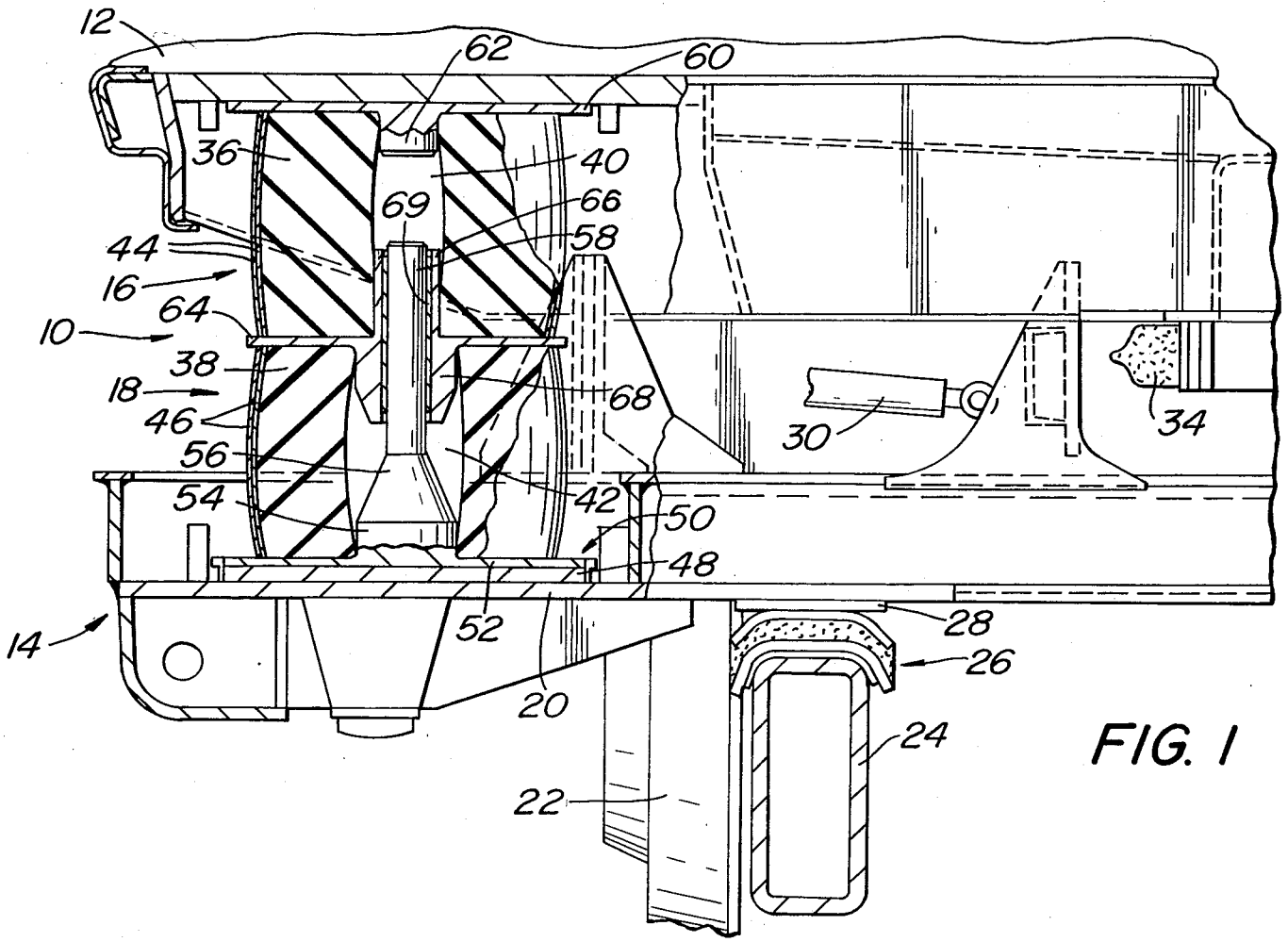
FIG. 1 is a partial view of a railway car, illustrating partly broken away and partly in cross-section a preferred embodiment of a pair of stacked elastomeric springs, in accordance with the present invention.

Referring to FIG. 1, a portion of a railway car somewhat similar to the one illustrated in U.S. Pat. No. 4,355,583 is illustrated. Because the invention is primarily directed toward having a pair of stacked springs between a railway car body and a truck, many elements associated with the truck and car body are not illustrated because they are known to those skilled in the art and only indirectly related to the present invention.

A suspension system 10 is disposed between a car body 12 and a truck 14. The suspension system includes a pair of stacked springs 16 and 18.

The truck 14 is adapted to receive a wheel axle assembly including the wheel 22, a side frame 24, a side bearing assembly 26 connected between the side frame 24 and a bolster 20. A wear plate 28 is connected between the side bearing 26 and the bolster 20. A lateral shock absorber 30 is connected between the truck 14 and the car body 12. Lateral bumpers 34 are provided to limit the lateral movement between the truck 14 and the car body 12. Because the invention is primarily concerned with the springs 16 and 18, no further reference will be made to the car body or truck.

The springs 16 and 18 may be, but not necessarily, comprise the so-called "Marsh-Mellow" type made by Firestone previously mentioned. These springs 16 and 18 include elastomeric cores 36 and 38 with hollow center openings 40 and 42, respectively. The spring 16 includes plies of a cord reinforced fabric 44 which provides an outer cover. Likewise, the spring 18 includes plies of a cord reinforced fabric 46 which provides an outer cover. No claim to the composition of the elastomeric springs per se is made. The invention is directed toward the manner in which the springs are used.

A spacer element 48 is connected between the bolster 20 and a bottom plate assembly 50. The bottom plate assembly 50 may be a single piece or made of a number of pieces welded or otherwise connected together.

A bottom plate assembly includes a bottom plate 52 with an upwardly extending restricting member extending upwardly through opening 42 partly into the opening 40. The restricting member includes a bottom portion 54 having a diameter corresponding to the opening 42, a central tapered portion 56 and an upper portion 58.

A top plate assembly includes a plate 60 secured to the car body 12 having a central element 62 extending downwardly into the opening 40.

A central plate assembly includes a plate 64 having a central opening. An upwardly extending portion 66 and a downwardly extending portion 68 are provided to permit the portion 58 to be moved therethrough. A low friction bearing surface 69 is provided to prevent metal-to-metal contact between portion 58 and portions 66 and 68 during relative movements therebetween.

In operation, consider first the vertical movement. Under heavy loads, the springs 16 and 18 will tend to compress vertically and expand. While they are being compressed, they will be held in place by the upper narrow portion 58, guided by the central plate 64 and projecting portions 66 and 68. The two springs 16 and 18 are free to move vertically without any restrictions. Consequently, the full vertical characteristics of the springs 16 and 18 are employed.

In considering the lateral movements of the springs 16 and 18, the top spring 16 is allowed to move to a great extent in the lateral direction. The lower spring 18, however, is restricted by the lower portion 54 as well as the downwardly extending portion 68 which are disposed within the center opening 42 of the spring 18. The degree of lateral movement of the spring 16 is dependent upon how far the upper narrow portion 58 and upwardly extending portion 66 extend into the opening 40. Basically, in the present invention, it is contemplated to give free vertical movements for both springs with a limited lateral movement for at least one of the springs in the manner illustrated.

Figure 2:
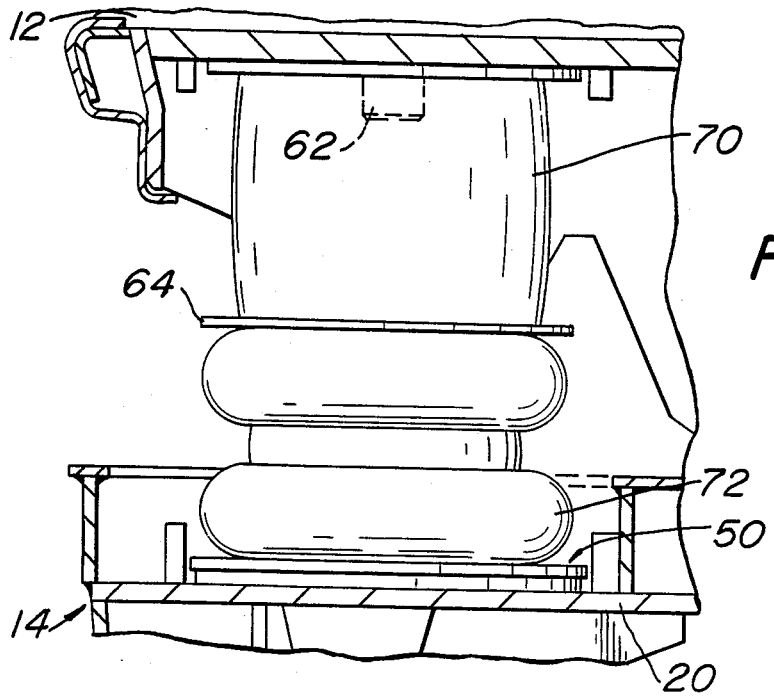
FIGS. 2 and 3 illustrate two additional embodiments of a pair of stacked springs, in accordance with the present invention.

Referring to FIG. 2, a second embodiment of the invention includes a pair of stacked springs 70 and 72. The spring 70 comprises an elastomeric member similar to the one illustrated in FIG. 1. The bottom spring 72 comprises a conventional air spring or bellows type spring, known to those skilled in the art. The bottom spring 72 is restricted from moving laterally by any conventional means which may be employed outside the air springs or by elements within the air spring (not illustrated).

Figure 3:
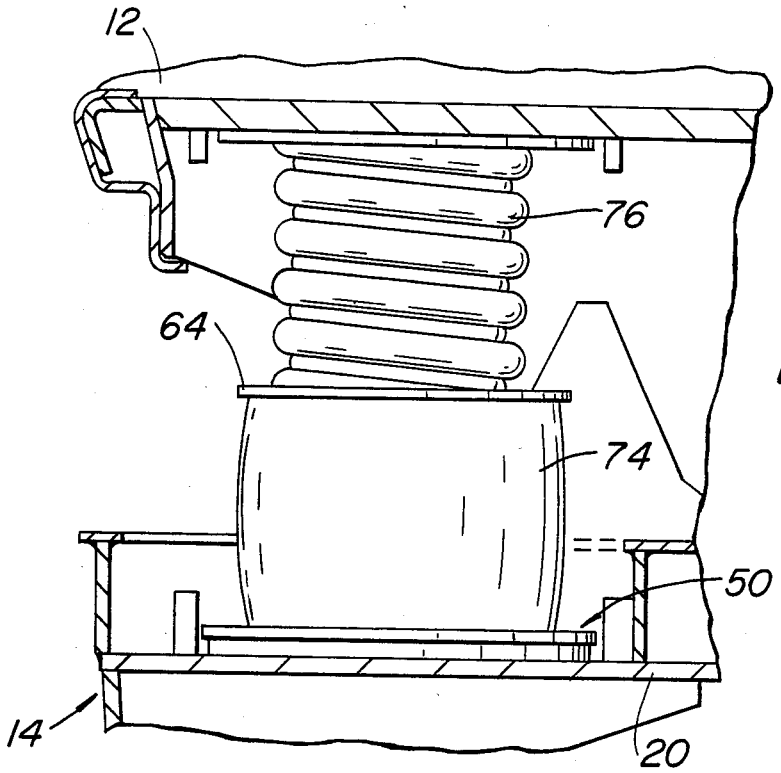

Referring to FIG. 3, another embodiment of the present invention includes a bottom elastomeric spring 74 and a top mechanical spring 76. Again, the elastomeric spring 74 may be restricted in lateral movement by means illustrated in connection with the spring 18 of FIG. 1, or by other mechanical elements.

While FIG. 1 is the preferred embodiment, in some cases it is recognized that the embodiments of FIGS. 2 and 3 having an air spring or a mechanical spring may have some advantages or be necessary in special situations where the maximum freedom from vibrations and the like are not critical.

What is claimed is:

1. In combination with a railway car including a main body and a truck having a bolster, suspension means connected between said main body and truck comprising:

(a) a pair of stacked upper and lower elastomeric springs, having center openings therein and plies of reinforced fabric material forming outer covers, (b) means including a mid-plate assembly for restricting the lateral movement of said stacked springs, (c) an upward projecting member secured towards the bottom of said lower spring and extending through the opening of said lower spring and only partly into the opening of said upper spring so that the upper spring is unrestricted in a central portion, (d) said mid-plate assembly including:

a plate portion disposed between said upper and lower springs, upwardly and downwardly portions extending from said plate portion only partly into the openings of said upper and lower springs, respectively, said plate and said upwardly and downwardly extending portions all including centrally disposed openings to receive said projecting member therethrough, whereby both of said springs are free to move vertically and said upper spring is free to move vertically and relatively free to move laterally.

2. The combination as set forth in claim 1 wherein a fixed top plate is disposed on the top of said upper spring, with said top plate having centrally disposed restraining element extending downwardly into the center opening of said upper spring.

3. A combination as set forth in claim 2 wherein said upwardly projecting member includes a bottom portion corresponding to the center opening of the bottom elastomeric spring and a top portion corresponding to the center opening in said mid-plate assembly.

4. A combination as set forth in claim 2 wherein a low friction bearing is provided between said projecting member and said upwardly and downwardly extending portions of said mid-plate assembly.

* * * * *